US011273614B2

(12) United States Patent
Onishi

(10) Patent No.: US 11,273,614 B2
(45) Date of Patent: Mar. 15, 2022

(54) PRESS DEVICE, AND TRANSPORT MOTION SETTING METHOD AND TRANSPORT MOTION SETTING PROGRAM OF PRESS DEVICE

(71) Applicant: SUMITOMO HEAVY INDUSTRIES, LTD., Tokyo (JP)

(72) Inventor: Seiki Onishi, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 58 days.

(21) Appl. No.: 16/896,410

(22) Filed: Jun. 9, 2020

(65) Prior Publication Data

US 2020/0391469 A1 Dec. 17, 2020

(30) Foreign Application Priority Data

Jun. 11, 2019 (JP) ..... JP2019-108663

(51) Int. Cl.
*B30B 15/14* (2006.01)

(52) U.S. Cl.
CPC ..... *B30B 15/146* (2013.01)

(58) Field of Classification Search
CPC ..... B30B 15/00; B30B 15/146; B30B 15/30; B30B 15/304; B30B 1/26; B21D 43/05; B21D 43/10; B21D 43/105; B21J 9/022; B21J 9/20; B21K 27/04
See application file for complete search history.

(56) References Cited

U.S. PATENT DOCUMENTS 7,410,046 B2 * 8/2008 Shiroza ..... B21D 43/10 198/468.4
8,640,614 B2 * 2/2014 Nishida ..... B21D 24/005 100/207
2010/0313624 A1 * 12/2010 Dekita ..... B21D 43/055 72/361

FOREIGN PATENT DOCUMENTS

JP 2016-215240 A 12/2016

* cited by examiner

*Primary Examiner* — Jimmy T Nguyen
(74) *Attorney, Agent, or Firm* — Michael Best & Friedrich LLP

(57) ABSTRACT

There is provided a press device including a reference operation setting unit that sets a reference transport motion of a transport device which corresponds to a predetermined reference press motion of the slide, a timing setting unit that sets a synchronous timing of the reference transport motion for the reference press motion, a press operation setting unit that sets a press motion of an actual operation by extending a time of a part of the reference press motion, and a transport operation setting unit that sets a transport motion of the actual operation which corresponds to the press motion by matching synchronous timings with each other between the press motion and the reference transport motion for the reference press motion, and by setting an operation pattern from the synchronous timing to be the same as that of the reference transport motion.

7 Claims, 9 Drawing Sheets

PRESS DEVICE, AND TRANSPORT MOTION SETTING METHOD AND TRANSPORT MOTION SETTING PROGRAM OF PRESS DEVICE

RELATED APPLICATION

The content of Japanese Patent Application No. 2019-108663, on the basis of which priority benefits are claimed in an accompanying application data sheet, is in its entirety incorporated herein by reference.

BACKGROUND

Technical Field

Certain embodiments of the present invention relate to a press device, and a transport motion setting method and a transport motion setting program of a press device.

Description of Related Art

In the related art, as a press device, a device is known in which a transfer feeder (hereinafter, referred to as a "TF") that transports a workpiece and a press unit are linked with each other by using a press master method based on a press operation. The press master method has an advantage in that high-speed productivity can be expected compared to a TF master method based on a TF operation.

In addition, for example, in a case where the press master method is applied to a so-called servo press in which an eccentric shaft is directly driven using a servomotor, acceleration or deceleration torques when starting/stopping a top dead center are unnecessary due to a continuous press operation. Therefore, the press master method also has an advantage in that effective torques of the servomotor can be reduced.

Incidentally, the press master method is used on a premise that a press speed (rotation speed of the eccentric shaft) is constant. Therefore, as illustrated in FIG. 6A, if a TF motion (operation of each TF shaft including TF lift, TF advance and TF clamp shown in FIG. 6A) corresponding to a press motion of one stroke is once determined, as illustrated in FIG. 6B, the TF motion does not need to be changed even in a case where the press speed is changed (in an illustrated example, time extension as a whole).

However, in some cases of the servo press, the press speed may be sequentially changed during one stroke. In this case, an operation speed of the TF is suddenly changed depending on a timing, thereby causing a possibility that stable transport may be difficult.

Therefore, as illustrated in FIG. 7A, a method is used in which the press motion and the TF motion (including TF lift, TF advance and TF clamp shown in FIG. 7A) are associated with each other by using a virtual cam having a constant speed as a common master. According to this method, as illustrated in FIG. 7B, in a case where a portion of the press motion is changed (in an example illustrated FIGS. 7A and 7B, change for gentle pressurization near a bottom dead center), the press motion and the TF motion can be associated with each other by changing/adjusting the TF motion portion corresponding to the changed portion.

SUMMARY

However, according to the above-described technique in the related art, it is necessary to appropriately set the TF motion in accordance with a change in the press motion.

According to an embodiment of the present invention, there is provided a press device.

The press device includes a slide attached a die configured to press form a forming material, a transport device configured to transport the forming material, the slide and the transport device being linked with each other, a reference operation setting unit that sets a reference transport motion of the transport device which corresponds to a predetermined reference press motion of the slide, a timing setting unit that sets a synchronous timing of the reference transport motion for the reference press motion, a press operation setting unit that sets a press motion of an actual operation by extending a time of a part of the reference press motion, and a transport operation setting unit that sets a transport motion of the actual operation which corresponds to the press motion by matching synchronous timings with each other between the press motion and the reference transport motion for the reference press motion, and by setting an operation pattern from the synchronous timing to be the same as that of the reference transport motion.

In addition, according to an embodiment of the present invention, there is provided a transport motion setting method for a press device by a control unit of the press device.

The method includes setting a reference transport motion of a transport device which corresponds to a predetermined reference press motion of a slide, the slide attached a die configured to press form a forming material, the transport device being configured to transport the forming material, the slide and the transport device being linked with each other, setting a synchronous timing of the reference transport motion for the reference press motion, setting a press motion of an actual operation by extending a time of a part of the reference press motion, and setting a transport motion of the actual operation which corresponds to the press motion by matching synchronous timings with each other between the press motion and the reference transport motion for the reference press motion, and by setting an operation pattern from the synchronous timing to be the same as that of the reference transport motion.

In addition, according to an embodiment of the present invention, there is provided a computer readable medium storing a transport motion setting program of a press device.

The transport motion setting program causes a control unit of the press device to function as a reference operation setting unit that sets a reference transport motion of a transport device which corresponds to a predetermined reference press motion of a slide, the slide attached a die configured to press form a forming material, the transport device being configured to transport the forming material, the slide and the transport device being linked with each other, a timing setting unit that sets a synchronous timing of the reference transport motion for the reference press motion, a press operation setting unit that sets a press motion of an actual operation by extending a time of a part of the reference press motion, and a transport operation setting unit that sets a transport motion of the actual operation which corresponds to the press motion by matching synchronous timings with each other between the press motion and the reference transport motion for the reference press motion, and by setting an operation pattern from the synchronous timing to be the same as that of the reference transport motion.

BRIEF DESCRIPTION OF THE DRAWINGS

FIG. 5A illustrates each reference motion, and FIG. 5B illustrates a modification example of the reference motion.

DETAILED DESCRIPTION

It is desirable to provide a technique which enables a user to easily set a transport motion of a transport device in a case where a press motion is changed.

According to an embodiment of the present invention, in a case where a press motion is changed, a transport motion of a transport device can be easily set.

Hereinafter, an embodiment of the present invention will be described in detail with reference to the drawings.

Structure of Press Device

Figure 1:
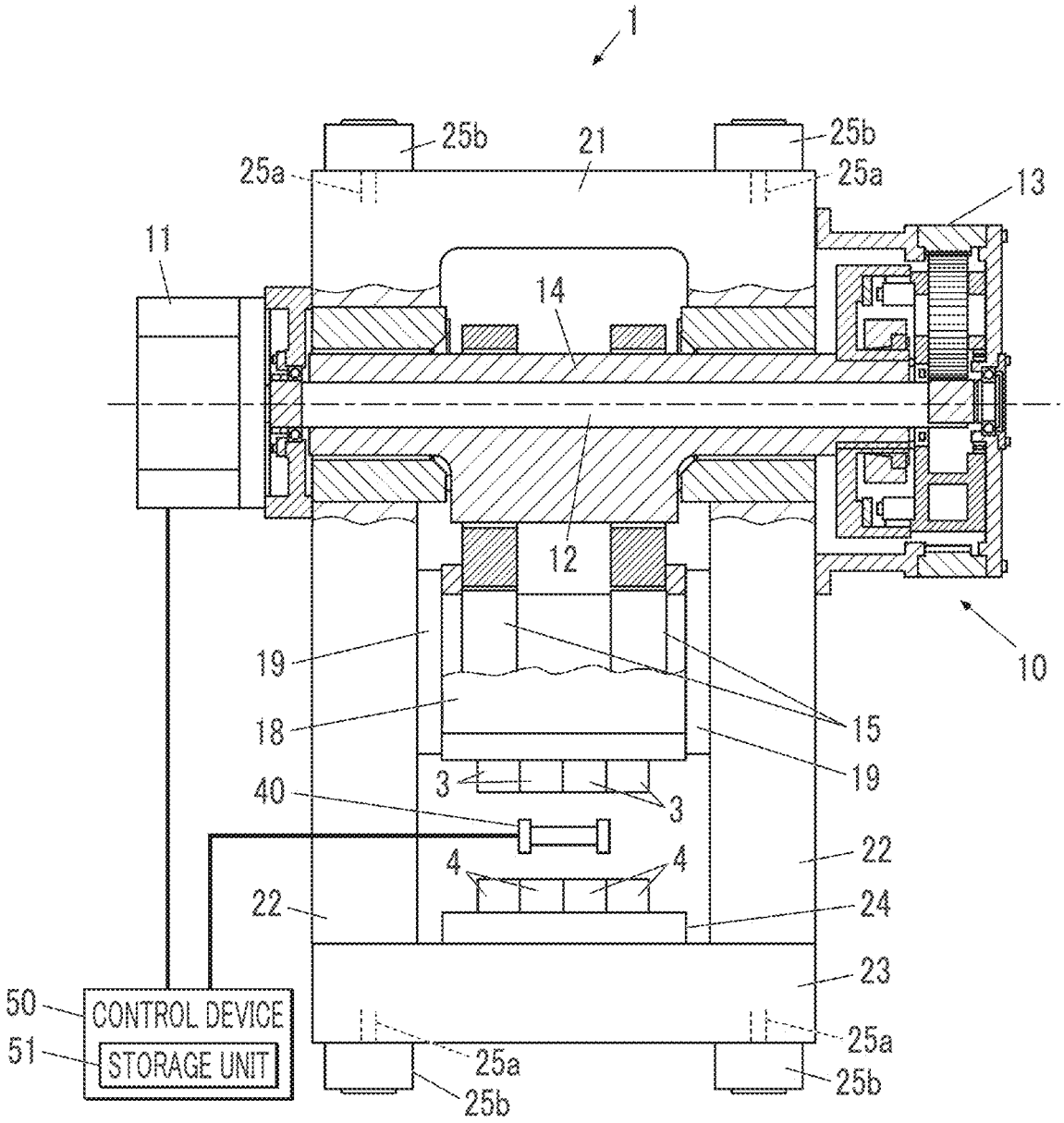
FIG. 1 is a view illustrating a press device according to an embodiment.
Figure 2:
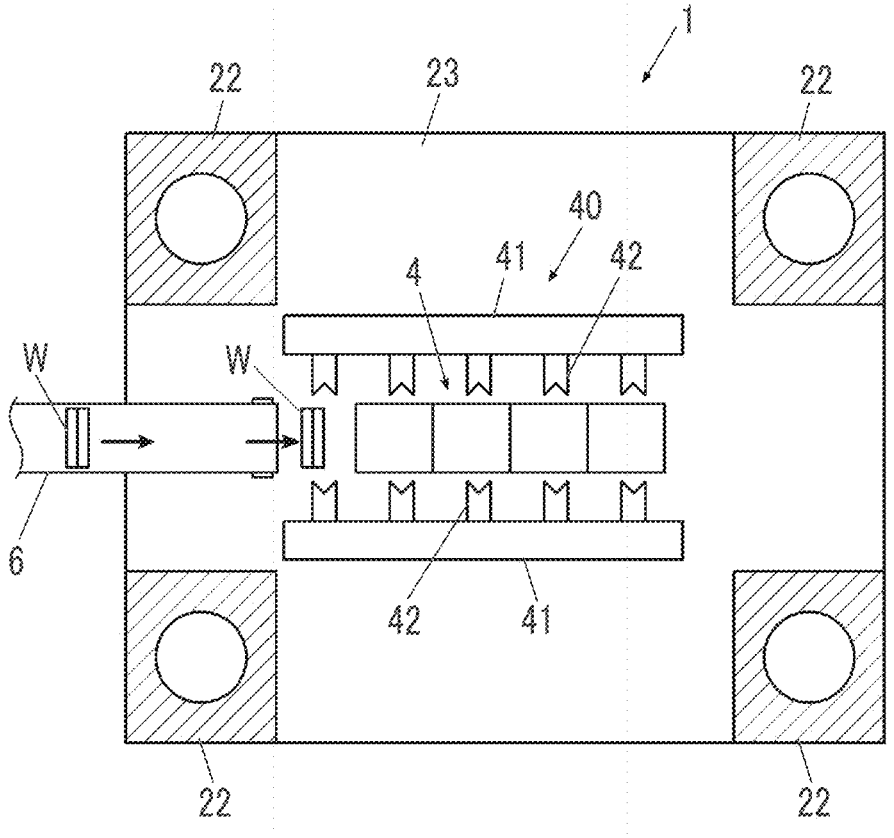
FIG. 2 is a plan view for describing a structure of a transfer feeder according to the present embodiment.

FIG. 1 is a view illustrating a press device 1 according to the present embodiment, and FIG. 2 is a plan view for describing a structure of a transfer feeder 40 included in the press device 1.

As illustrated in FIG. 1, the press device 1 according to the present embodiment is a forging press device that performs forging, and includes a bed 23, a plurality of uprights 22, a crown 21, a bolster 24, a slide 18, a drive unit 10, a control device 50, and the transfer feeder 40.

The bed 23, the plurality of uprights 22, and the crown 21 configure a frame unit of the press device 1. A tie rod 25*a* is inserted into the bed 23, the plurality of uprights 22, and the crown 21, and is tightened by a tie rod nut 25*b* so that the bed 23, the plurality of uprights 22, and the crown 21 are fastened to each other.

The bolster 24 is fixed onto the bed 23, and a plurality of lower dies 4 are fixed to an upper portion of the bolster 24.

The slide 18 is supported by a guide 19 disposed in each of the plurality of uprights 22 to be movable forward and rearward in an upward-downward direction. A plurality of upper dies 3 are fixed to a lower portion of the slide 18. The plurality of upper dies 3 and the plurality of lower dies 4 correspond to each other to respectively form sets, are respectively arrayed along a rightward-leftward direction, and face each other upward and downward in the respective sets. When the slide 18 descends, the upper die 3 and the lower die 4 move close to each other, and a forming material W is forged between the upper die 3 and the lower die 4. A direction in which the slide 18 moves forward and rearward is not particularly limited. However, the present embodiment will be described as an example in which the slide 18 moves forward and rearward in the upward-downward direction.

The drive unit 10 includes a servomotor 11, a transmission shaft 12, a speed reducer 13, an eccentric shaft 14, and a connecting rod 15. The drive unit 10 is supported by a frame unit such as the crown 21. The eccentric shaft 14 is disposed to extend along the rightward-leftward direction. When the servomotor 11 is driven, a rotary motion of the servomotor 11 is transmitted sequentially to the transmission shaft 12, the speed reducer 13, and the eccentric shaft 14. A rotary motion of the eccentric shaft 14 is converted into a translational motion of the slide 18 via the connecting rod 15. In this manner, the slide 18 moves forward and rearward in the upward-downward direction.

The servomotor 11 can be controlled to optionally change a rotation speed during one rotation or can be controlled to be stopped at an optional rotation angle. Therefore, since the servomotor 11 is controlled to be driven, a movement speed of upward ascending and downward descending operations of the slide 18 can be changed in one stroke, or can be stopped at an optional position.

The control device 50 controls operations of the press device 1. Specifically, the control device 50 controls the operations of the servomotor 11 and the transfer feeder 40, based on a user's operation or a predetermined program, and links a press operation of the slide 18 and a transport operation of the transfer feeder 40 with each other. In addition, the control device 50 includes a storage unit 51 that stores a program or data for realizing various functions of the press device 1, and that functions as a working memory region.

The transfer feeder 40 is a transport device that transports the forming material W, and is disposed near the upper die 3 and the lower die 4. As illustrated in FIG. 2, when the upper die 3 and the lower die 4 are separated from each other, the transfer feeder 40 supplies a new forming material W loaded by a loading device 6 to the upper die 3 and the lower die which are located on a most upstream side, or transports the forming material W to a plurality of sets of the upper die 3 and lower die 4 which are arrayed in the rightward-leftward direction.

Specifically, the transfer feeder 40 includes two feed rods 41 disposed in parallel with each other. The feed rods 41 are disposed to extend along an array direction thereof, on both sides of the plurality of lower dies 4 disposed in one row.

In each of the feed rods 41, a plurality of gripping claws 42, the number of which is one more than the number of the lower dies 4, are disposed in parallel along an extending direction of the feed rods 41. The plurality of gripping claws 42 extend from each of the feed rods 41 so that the gripping claws 42 disposed in the two feed rods 41 face each other by forming a set. In addition, an interval in the array direction of the plurality of gripping claws 42 coincides with an interval of the plurality of lower dies 4.

Figure 3:
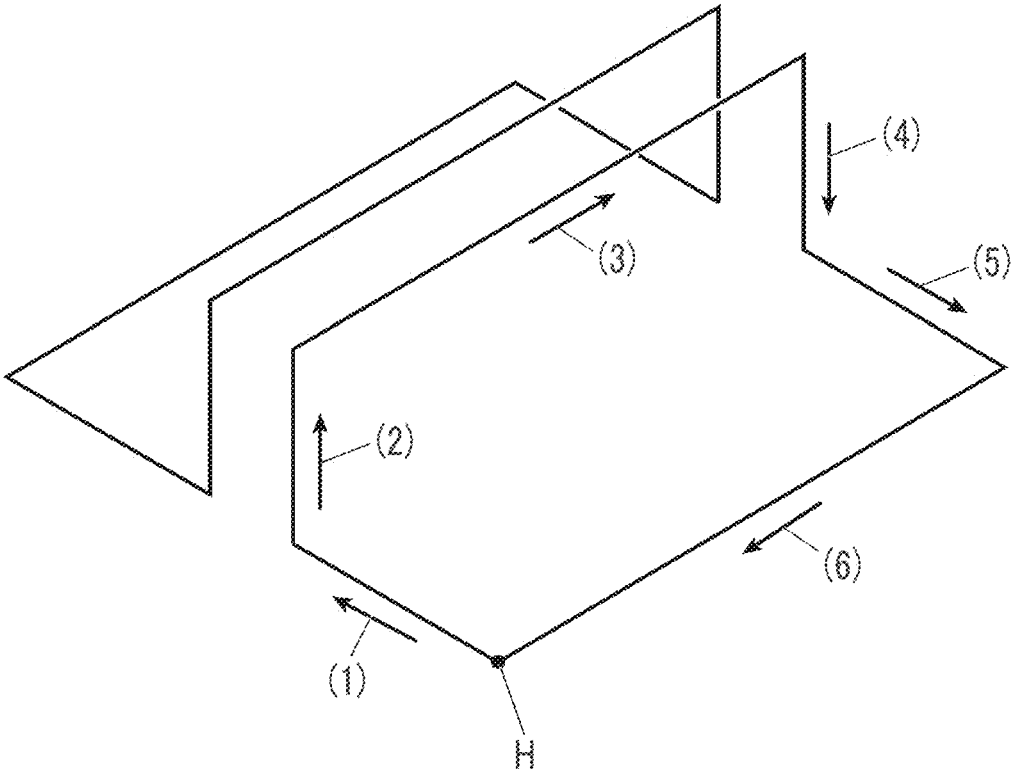
FIG. 3 is a view for describing an operation, which illustrates a movement trajectory of a feed rod of the transfer feeder according to the present embodiment.

FIG. 3 is a view for describing an operation, which illustrates a movement trajectory of the feed rod 41 of the transfer feeder 40.

As illustrated in the drawing, the transfer feeder 40 causes the two feed rods 41 in a standby state at a standby position (home position) H to move sequentially to (1) Clamp→(2) Lift→(3) Advance→(4) Down→(5) Unclamp→(6) Return. In this manner, the transfer feeder 40 sequentially feeds the forming material W to the plurality of lower dies 4 by linking a transport operation with a press operation of the slide 18. In the following description, a clamp and unclamp operation direction will be referred to as a clamp direction, a lift and down operation direction will be referred to as a lift direction, and an advance and return operation direction will be referred to as an advance direction.

Transfer Feeder Motion Setting Method

Subsequently, a method of setting a transfer feeder motion (hereinafter, referred to as a "TF motion") in association with a press motion will be described. Here, a "press motion" refers to a press operation pattern obtained by the slide 18. In addition, the "TF motion" is a transport operation pattern of the transfer feeder 40, and is represented by a clamp direction operation amount, a lift direction operation amount, and an advance direction operation amount (to be described later). The TF motion setting method according to the present embodiment is executed in such a manner that a predetermined program stored in the storage unit 51 is read and deployed by the control device 50.

Figure 4:
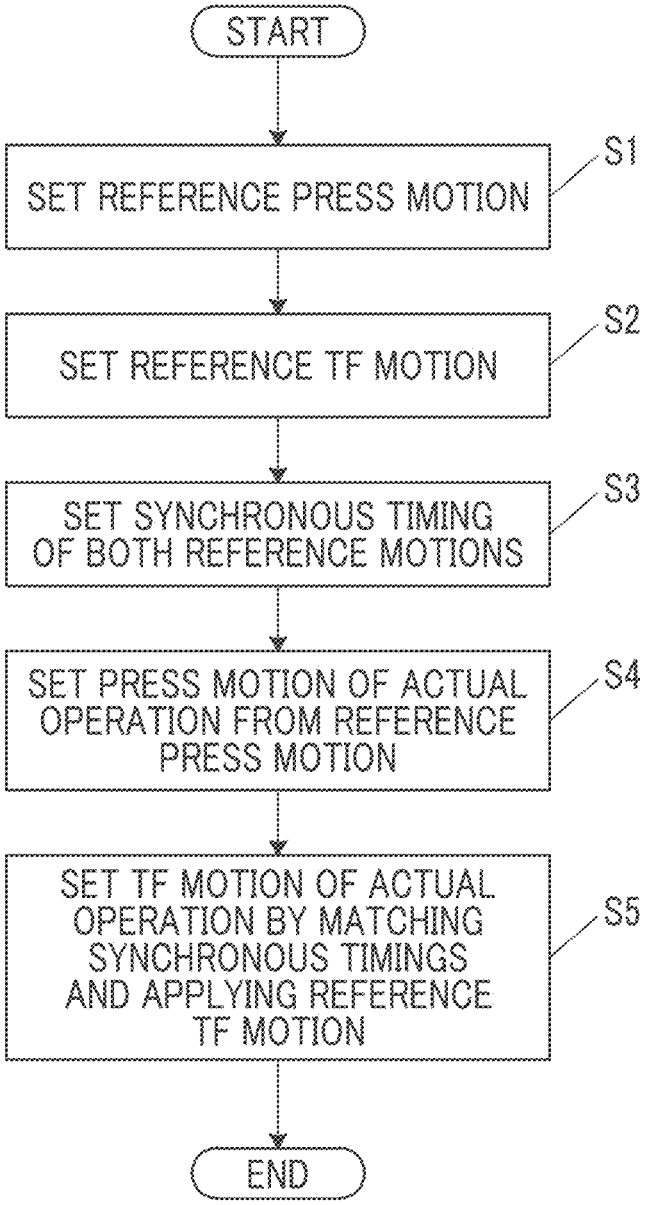
FIG. 4 is a flowchart illustrating a flow of a transfer feeder motion setting method according to the present embodiment.
Figure 5A:
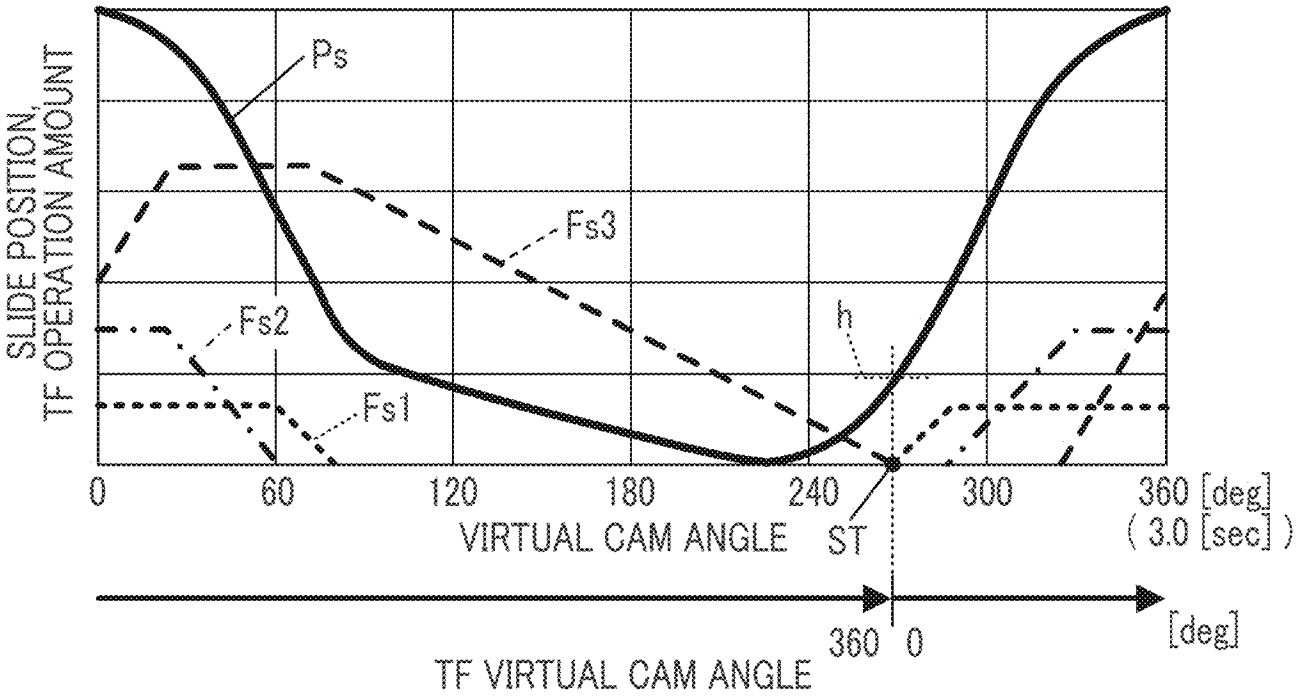
FIGS. 5A and 5B are operational diagrams illustrating a press motion and a TF motion according to the present embodiment.
Figure 5B:
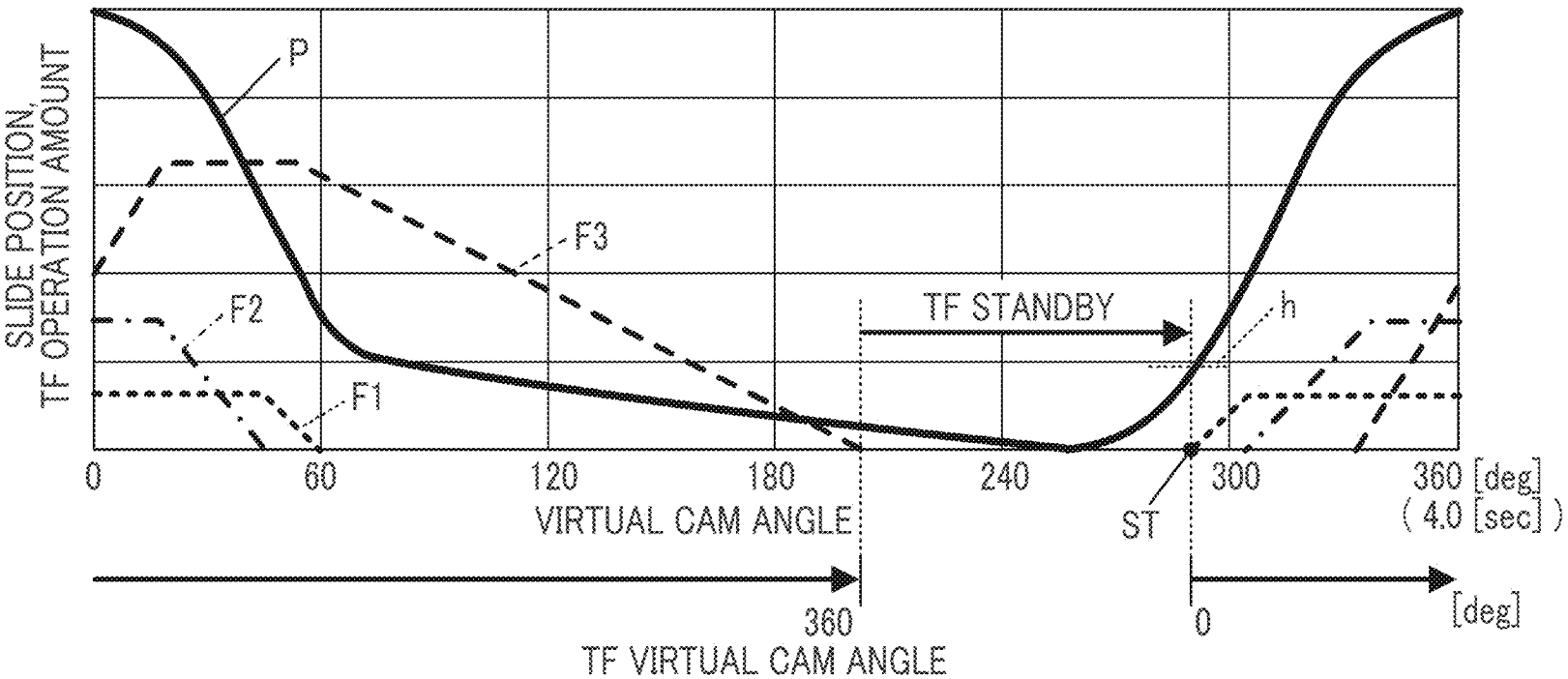
Figure 6A:
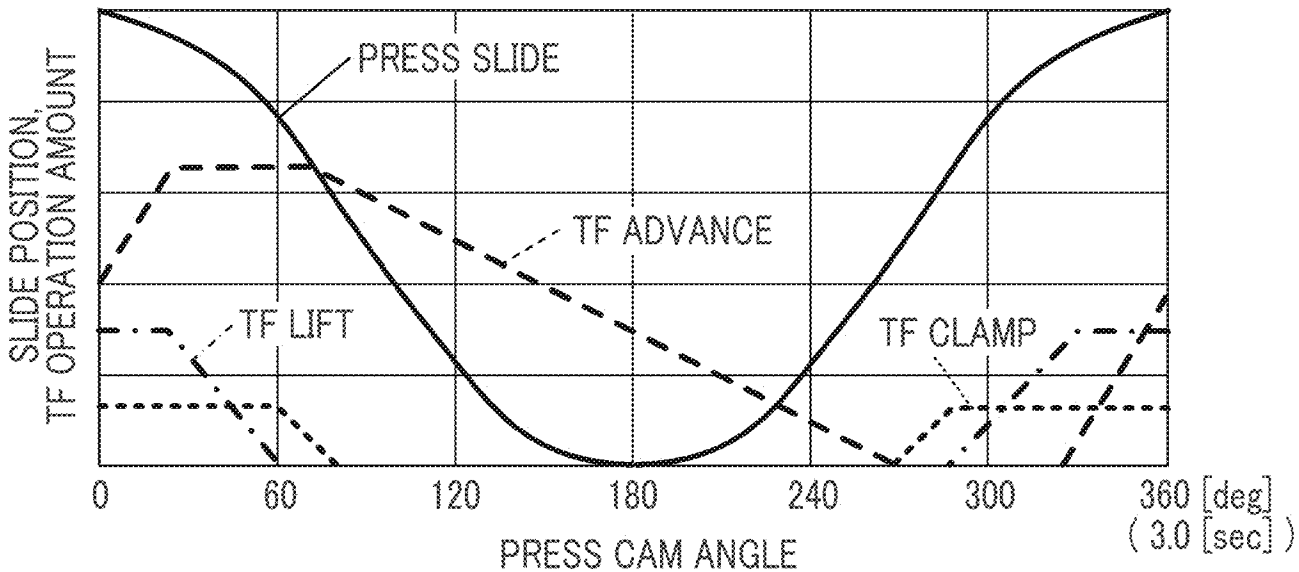
FIG. 6A RELATED ART
FIGS. 6A and 6B are operational diagrams illustrating an example of a press motion and a TF motion in the related art.
Figure 6B:
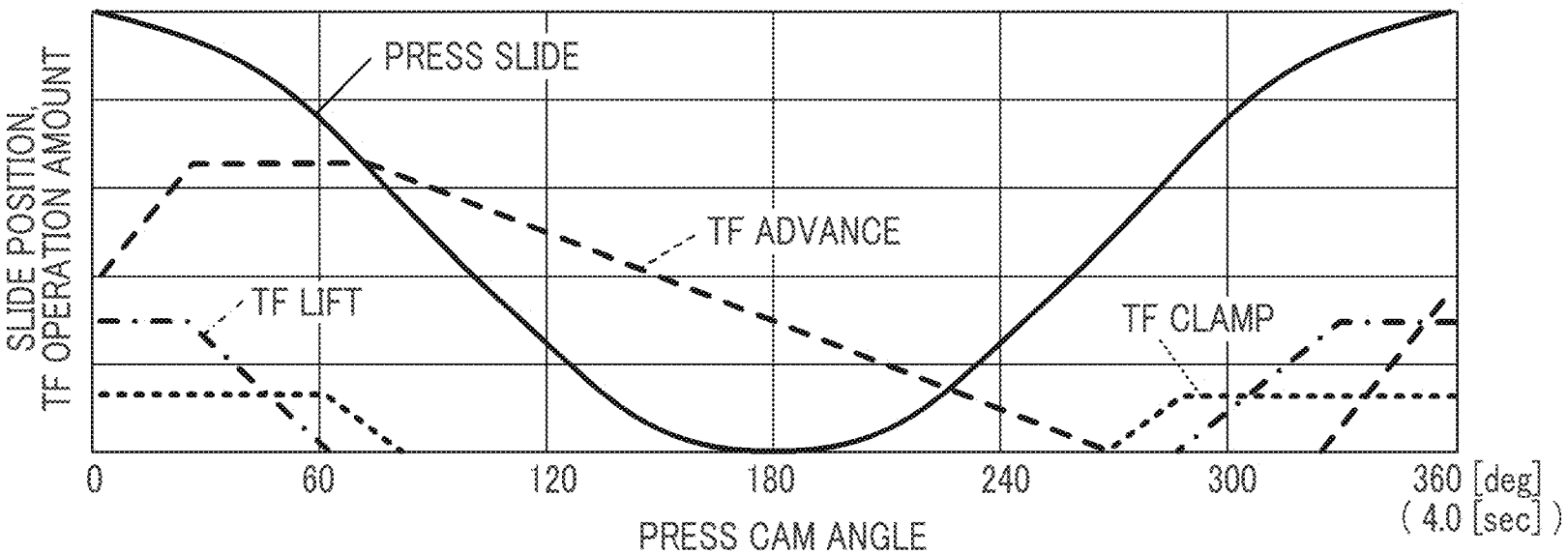
FIG. 6B RELATED ART
Figure 7A:
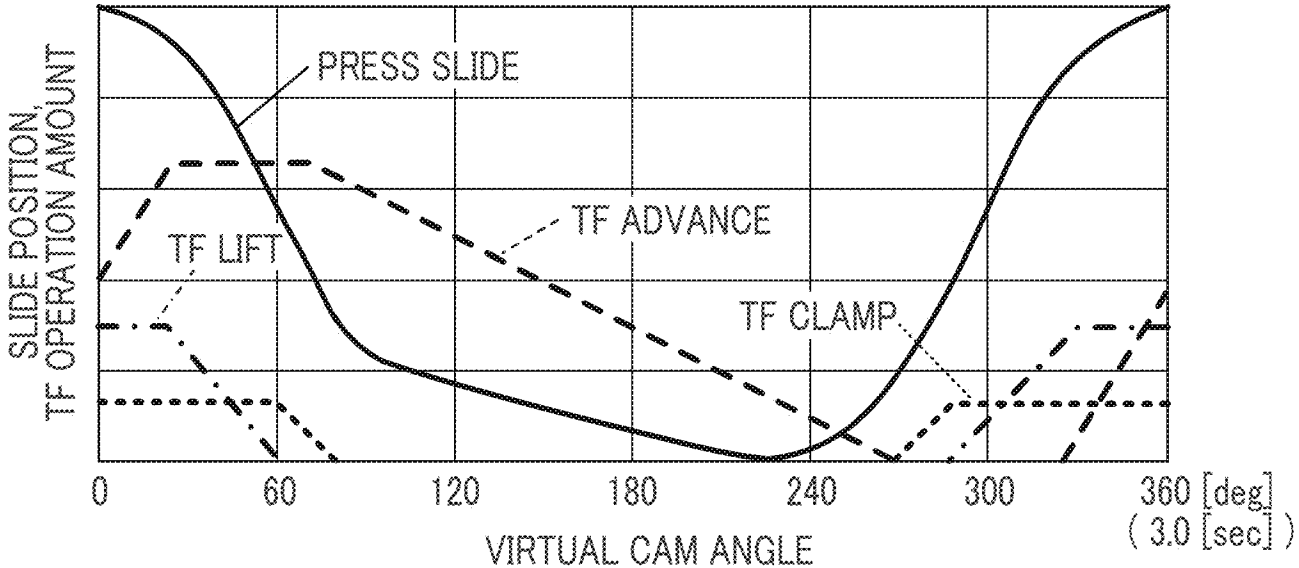
FIG. 7A RELATED ART
FIGS. 7A and 7B are operational diagrams illustrating another example of the press motion and the TF motion in the related art.
Figure 7B:
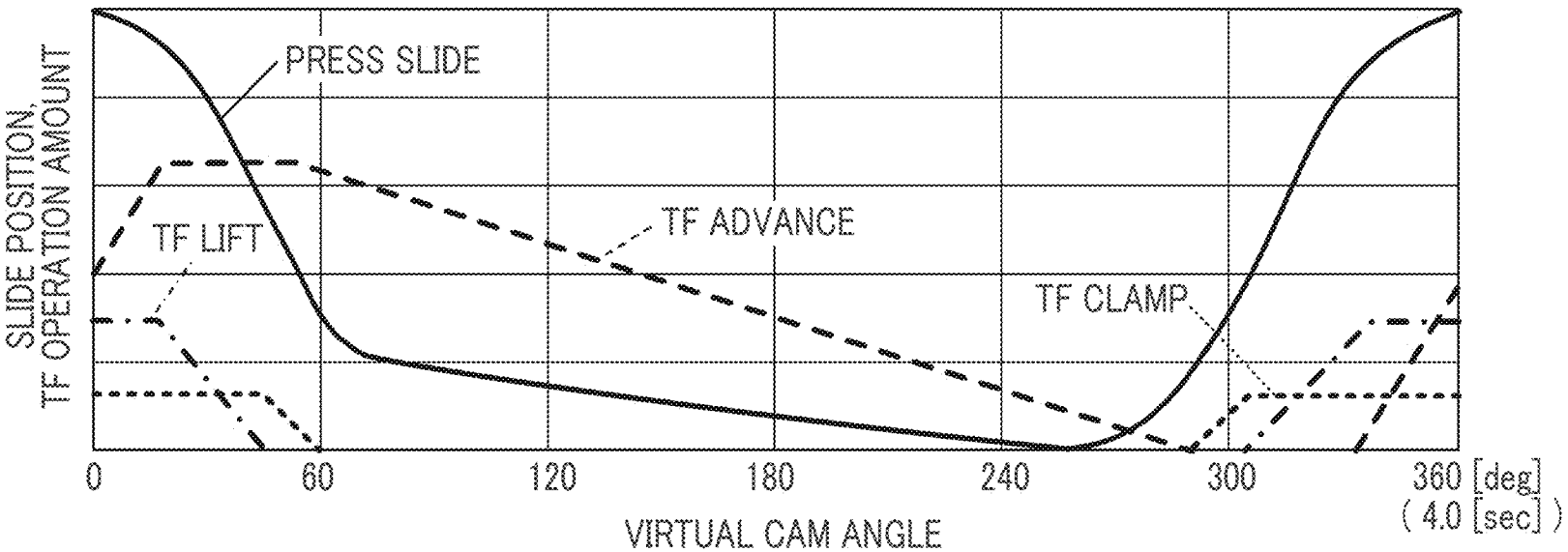
FIG. 7B RELATED ART

FIG. 4 is a flowchart illustrating a flow of the TF motion setting method. FIGS. 5A and 5B are operational diagrams illustrating the press motion and the TF motion according to the present embodiment. FIG. 5A illustrates each reference motion, and FIG. 5B illustrates a modification example of the reference motion. In the drawing, the press motion is indicated at a position of the slide 18 in one stroke of a forward-rearward movement of the slide 18 until the slide 18 returns again to a top dead center after passing through a bottom dead center from the top dead center. As will be described later, the TF motion is indicated by an operation amount of the transfer feeder 40 (feed rod 41) in each direction (clamp, lift, and advance directions). In addition, a horizontal axis in FIGS. 5A and 5B represents a rotation angle of a virtual cam (virtual cam angle), which is obtained on an assumption that the slide 18 rotates once (rotates 360 degree) at a constant angular velocity when the slide 18 rotates one stroke, and a time corresponding to the rotation angle of the virtual cam.

As illustrated in FIG. 4, in the TF motion setting method according to the present embodiment, the control device 50 first sets a reference press motion Ps which is a reference for the press motion (Step S1).

The reference press motion Ps is the press motion at a shortest cycle time assumed in equipment specifications of the press device 1. As illustrated in FIG. 5A, the reference press motion Ps according to the present embodiment means the followings. The slide 18 gently moves near a front side of the bottom dead center where the forming material W is pressurized, and before and after the movement, the slide 18 quickly moves at a constant speed corresponding to performance of the servomotor 11. In addition, for example, the reference press motion Ps according to the present embodiment requires 3 seconds for one stroke (cycle).

The control device 50 sets the reference press motion Ps, based on mechanical specifications of the press device 1 or press conditions such as a cycle time, and causes the storage unit 51 to store the reference press motion Ps. The reference press motion Ps may be set in advance, and may be stored in the storage unit 51.

Next, the control device 50 sets a reference TF motion Fs corresponding to the set reference press motion Ps (Step S2).

The reference TF motion Fs is configured to include a clamp direction operation amount Fs1, a lift direction operation amount Fs2, and an advance direction operation amount Fs3 of the transfer feeder 40. The reference TF motion Fs is the TF motion corresponding to the reference press motion Ps, and is set so that the transfer feeder 40 can preferably transport the forming material W without interfering with the press operation (slide 18) of the reference press motion Ps. That is, the reference TF motion Fs is set so that the transport operation starts (from (1) Clamp) when the slide 18 ascends to a predetermined position h where the slide 18 does not interfere with the transfer feeder 40 after passing through the bottom dead center, and so that the transport operation (to (5) Unclamp) is completed before the slide 18 subsequently descends to a position where the slide 18 interferes with the feeder 40.

The control device 50 sets the reference TF motion Fs, based on the reference press motion Ps, and causes the storage unit 51 to store the reference TF motion Fs. Details such as an operation speed of the transfer feeder 40 in the reference TF motion Fs are appropriately set, based on other mechanical device specifications or the cycle time of the transfer feeder 40. In addition, the reference TF motion Fs may be set in advance together with the reference press motion Ps, and may be stored in the storage unit 51.

Next, the control device 50 sets a synchronous timing (synchronous point) ST of the reference TF motion Fs for the reference press motion Ps (Step S3). The synchronous timing is a point of the TF motion to be synchronized with the press motion regardless of a change in the press motion.

In this step, as the synchronous timing ST, the control device 50 sets a point at which the transfer feeder 40 starts the clamp operation, that is, a timing at which the slide 18 ascends to a position h where the slide 18 does not interfere with the transfer feeder 40 after passing through the bottom dead center, and causes the storage unit 51 to store the timing.

Then, the control device 50 sets a rotation angle of a virtual cam (TF virtual cam angle) for the transfer feeder 40, which is obtained on an assumption that the transfer feeder 40 rotates once (rotates 360 degree) at a constant angular velocity when the transfer feeder 40 is operated one cycle while the synchronous timing ST is set as a starting point (zero).

Next, the control device 50 changes/adjusts the reference press motion Ps, based on a user (operator) operation, and sets a press motion P of an actual operation (Step S4).

Specifically, as illustrated in FIG. 5B, the press motion P is set by extending a time for pressurizing the forming material W for the reference press motion Ps (in the present embodiment, a cycle time: 3 seconds→4 seconds). In this case, a new virtual cam angle obtained on an assumption that the slide 18 rotates once (rotates 360 degree) within the extended time is assigned.

Specific contents of the change/adjustment of the press motion P are not particularly limited as long as the press motion P extends the operation time near the bottom dead center until the forming material W is clamped again after the forming material W is unclamped in the reference press motion Ps. For example, FIG. 5B illustrates an example in which the slide 18 descends (pressurization) at a constant speed near the bottom dead center. However, during the pressurization, the speed may be changed, or the slide 18 may ascend once. Furthermore, in the press motion P, a time of apart of the reference press motion Ps may be extended.

Next, the control device 50 set the TF motion F of the actual operation which corresponds to the press motion P by matching the synchronous timing ST with that of the press motion P, and by setting an operation pattern from the synchronous timing ST to be the same as that of the reference TF motion Ts (Step S5). The TF motion F is configured to include a clamp direction operation amount F1, a lift direction operation amount F2, and an advance direction operation amount F3 of the transfer feeder 40.

That is, the TF motion F is set so that the synchronous timing ST of the press motion P whose time is extended is matched with the synchronous timing ST of the reference TF motion Fs for the reference press motion Ps for the press motion P, and so that the reference TF motion Ts whose time is not extended is performed while the original TF virtual cam angle is maintained. Therefore, in the clamp direction operation amount F1, the lift direction operation amount F2, and the advance direction operation amount F3 which configure the TF motion F, the operation pattern from the synchronous timing ST is matched with that of the reference TF motion Ts. Then, the transfer feeder 40 is in a standby state in which the transfer feeder 40 is not operated until the subsequent clamp starts (that is, the synchronous timing ST) after the return ends in the TF motion F.

In this way, the TF motion F is automatically set in accordance with the set press motion P. The control device 50 causes the storage unit 51 to store the set TF motion F.

Technical Effects of Present Embodiment

As described above, according to the present embodiment, the reference TF motion Fs corresponding to the reference press motion Ps of the slide 18 is set, and the synchronous timing ST of the reference TF motion for the reference press motion Ps is set. Then, when the press motion P of the actual operation is set by extending a part of the reference press motion Ps, the TF motion F of the actual operation which corresponds to the press motion P is set by matching the synchronous timing ST for the press motion P with that for the reference press motion Ps, and by setting the operation pattern from the synchronous timing ST to be the same as that of the reference TF motion Fs.

Therefore, even in a case where the press motion is changed in any way from the reference press motion Ps, (an operation portion of) the TF motion is the reference TF motion Fs without any change. Accordingly, no special change/adjustment is required. Therefore, in a case where the press motion is changed, the TF motion of the transfer feeder 40 can be easily set.

In addition, according to the present embodiment, the press motion P of the actual operation is set by extending the time of the part of the reference press motion Ps which corresponds to the time from until the transport operation starts again (from the clamp) after the transfer feeder 40 completes the transport operation (until the unclamp).

In this manner, the pressurizing operation near the bottom dead center corresponding to the portion can be desirably changed, and the press motion P can be set.

OTHERS

Hitherto, the embodiment of the present invention has been described. However, the present invention is not limited to the above-described embodiment.

For example, in the above-described embodiment, a case has been described where the TF motion is set based on the press motion. However, in a case where the press device 1 is actually driven using the TF motion, when the synchronous timing ST is detected, the control device 50 may output a transport start command to the transfer feeder 40, and may cause the transfer feeder 40 to perform the transport operation by using the operation pattern the same as that of the reference TF motion Fs. When the synchronous timing ST is detected, for example, a detector for detecting the forward movement/rearward movement position of the slide 18 may be provided so that the slide position corresponding to the synchronous timing ST can be detected.

In addition, a structure of the press device according to the present invention is not particularly limited as long as the press device includes the transfer feeder linked with the slide. However, the present invention is more preferably applicable to a so-called servo press in which the slide is driven using the servomotor, for example.

In addition, details in the above-described embodiment can be appropriately modified within the scope not departing from the concept of the invention.

It should be understood that the invention is not limited to the above-described embodiment, but may be modified into various forms on the basis of the spirit of the invention. Additionally, the modifications are included in the scope of the invention.

What is claimed is:

1. A press device comprising:

a slide attached a die configured to press form a forming material;

a transport device configured to transport the forming material, the slide and the transport device being linked with each other;

a reference operation setting unit configured to set a reference transport motion of the transport device which corresponds to a predetermined reference press motion of the slide;

a timing setting unit configured to set a synchronous timing of the reference transport motion for the reference press motion;

a press operation setting unit configured to set a press motion of an actual operation by extending a time of a part of the reference press motion; and a transport operation setting unit configured to set a transport motion of the actual operation which corresponds to the press motion by matching synchronous timings with each other between the press motion and the reference transport motion for the reference press motion, and by setting an operation pattern from the synchronous timing to be the same as that of the reference transport motion.

2. The press device according to claim 1, wherein the timing setting unit is configured to set, as the synchronous timing, a timing at which the slide passes through a bottom dead center and ascends to a predetermined position where the slide does not interfere with the transport device.

3. The press device according to claim 1,

Wherein the reference operation setting unit is configured to set the reference transport motion so that the transport device starts a transport operation when the slide passes through a bottom dead center and ascends to a predetermined position where the slide does not interfere with the transport device, and so that the transport device completes the transport operation before the slide subsequently descends to a position where the slide interferes with the transport device.

4. The press device according to claim 3, wherein the press operation setting unit is configured to set the press motion by extending a time of a portion in the reference press motion, which corresponds to a portion until the transport device starts the transport operation again after the transport device completes the transport operation in the reference transport motion.

5. The press device according to claim 1, wherein the slide is driven by a servomotor connected via a rotary shaft that causes the slide to reciprocate.

6. A transport motion setting method for a press device by a control unit of the press device comprising:

setting a reference transport motion of a transport device which corresponds to a predetermined reference press motion of a slide, the slide attached a die configured to press form a forming material, the transport device being configured to transport the forming material, the slide and the transport device being linked with each other;

setting a synchronous timing of the reference transport motion for the reference press motion;

setting a press motion of an actual operation by extending a time of a part of the reference press motion; and setting a transport motion of the actual operation which corresponds to the press motion by matching synchronous timings with each other between the press motion and the reference transport motion for the reference press motion, and by setting an operation pattern from the synchronous timing to be the same as that of the reference transport motion.

7. A computer readable medium storing a transport motion setting program of a press device causing a control unit of the press device to function as:

a reference operation setting unit configured to set a reference transport motion of a transport device which corresponds to a predetermined reference press motion of a slide, the slide attached a die configured to press form a forming material, the transport device being configured to transport the forming material, the slide and the transport device being linked with each other;

a timing setting unit configured to set a synchronous timing of the reference transport motion for the reference press motion;

a press operation setting unit configured to set a press motion of an actual operation by extending a time of a part of the reference press motion; and a transport operation setting unit configured to set a transport motion of the actual operation which corresponds to the press motion by matching synchronous timings with each other between the press motion and the reference transport motion for the reference press motion, and by setting an operation pattern from the synchronous timing to be the same as that of the reference transport motion.

* * * * *